United States Patent [19]

Mekari

[11] 3,959,971

[45] June 1, 1976

[54] COOLING SYSTEM

[76] Inventor: Milad H. Mekari, 17250 Raupp Road, Apt. 17B, Melvindale, Mich. 48122

[22] Filed: July 22, 1974

[21] Appl. No.: 490,224

[52] U.S. Cl. ..... 60/517

[51] Int. Cl.[2] ..... F01K 13/92

[58] Field of Search ..... 60/516, 517, 646, 657, 60/39.66; 92/98 D; 123/41.31, 41.34, 41.36, 41.37

[56] References Cited

UNITED STATES PATENTS

| | | | |
|---|---|---|---|
| 3,220,191 | 11/1965 | Berchtold | 60/516 X |
| 3,220,200 | 11/1965 | Damsz | 60/516 X |
| 3,477,226 | 11/1969 | Percival | 60/517 |
| 3,667,348 | 6/1972 | Neelen | 60/517 X |
| 3,811,789 | 5/1974 | Randell | 60/646 X |

FOREIGN PATENTS OR APPLICATIONS

| | | | |
|---|---|---|---|
| 124,828 | 4/1919 | United Kingdom | 60/646 |

*Primary Examiner*—Martin P. Schwadron
*Assistant Examiner*—H. Burks, Jr.
*Attorney, Agent, or Firm*—Harness, Dickey & Pierce

[57] ABSTRACT

Means are provided to enable the main water pump of a Stirling engine to act as a mini-pump to cool the roll sock seals or rolling diaphragms when the engine is not running.

6 Claims, 16 Drawing Figures

COOLING SYSTEM

BRIEF SUMMARY OF THE INVENTION

It is an object of this invention to provide a means for overcoming the problem of excessive heating of the roll sock seal of the Stirling engine when the engine is stopped.

It is another object of the invention to improve the cooling efficiency of the Stirling engine cooling system by eliminating a non-return valve and its pressure drop from the flow passage of the cooling system.

It is another object of the invention to eliminate the mini-pump and its non-return valve from the cooling system and to reduce the cost, weight, number of parts and occupied space of the cooling system of the Stirling engine.

It is another object of the invention to secure an effective cooling of the roll sock seal.

An additional object is to eliminate the resistance of the main water pump as an additional pressure drop acting against the working head of a mini-pump.

The invention achieves these objects by driving the main water pump at approximately 340 rpm and 10 gpm flow of water-glycol 50/50 mixture against the cooling system head of 10 to 11 inches of water and by eliminating a gear type mini water pump and its non-return valve from the engine assembly.

In one embodiment an electrical motor drives the main water pump with the help of two over-running clutches. One is assembled on the accessory shaft and the other on the electrical motor shaft. The electrical motor takes its signal from a thermostat that is plugged in the engine's cooling system cooler section so that when the coolant is hot (e.g. above 177° F) and the engine is not running a thermostat-relay closes the circuit causing the electrical motor and the main water pump to rotate, forcing coolant through the system and therefore cooling the roll sock seals.

DESCRIPTION OF THE INVENTION

Figure 1:
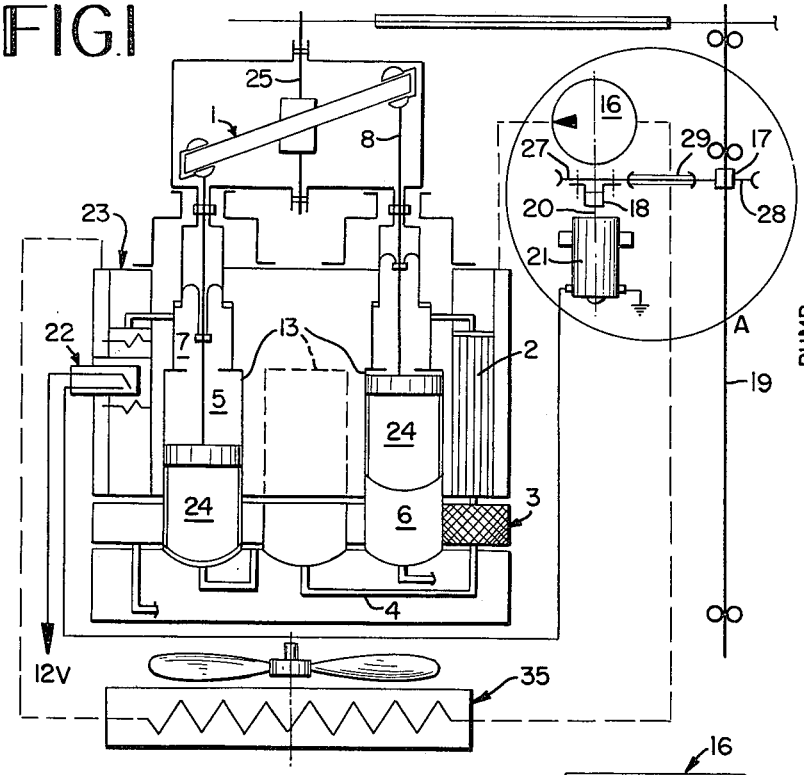
FIG. 1 is a schematic representaton of a Stirling engine utilizing a form of the invention and with two of the four cylinders shown in the plane of the drawing and a third cylinder also visible.

The Stirling engine principle is well known and its embodiment comprises generally an external combustion arrangement of four reciprocating double acting cylinders and pistons working on a two cycle arrangement in accordance with regenerative thermodynamics. There is a swash plate 1, a cooler 2, a regenerator 3, a heater 4, a compression chamber 5, an expansion chamber 6, and rolling diaphragms or roll sock seals 7. These are flexible diaphragms made from polyurethane or viton rubber fitted between the moving rod 8 and the fixed cylinder base 9 to separate the hot working gas H2 from the lubricating oil 11 in the crankcase. The seals prevent the leakage of the working gas and the penetration of the oil into the cylinders 13 and thereby close the Stirling engine cycle hermetically to prevent leak losses of power and efficiency. The oil pumping ring 14 and the regulating valve 15 maintain a safe level of pressure difference between the gas and the oil beneath the roll sock seal 7. As seen in FIG. 1, the reciprocating movement of the pistons 24 is transmitted to the main shaft 25 of the engine by the piston rod 8 and swash plate 1.

When the engine stops running the main water pump 16 and the circulating coolant also stop in a simple arrangement of the engine. The heat from the hot working gas H2 transfers from the engine's system out and through the roll sock seal 7 to expose it to over heating and damage. To prevent this, it has been considered necessary to circulate about 10 gpm of coolant through the cooling system around the cooler 2 for a period of time sufficient to take away excessive heat by means of passage of coolant through the radiator 35.

It has been proposed that an independent small gear type water pump (mini-pump) with a non-return valve be driven by an electric motor connected to the 12 V battery of the engine. However, this arrangement is relatively large in size, heavy, expensive, includes many pieces, and the non-return valve imposes a resistance or loss of head against the working head of the main water pump. Also, the main water pump is an additional head pressure drop against the head of the small gear pump which the latter requires power to overcome.

Figure 6:
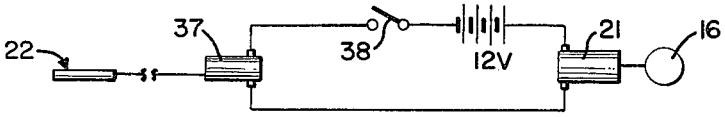
FIG. 6 is a schematic arrangement of the circuit showing a 12 V battery, mechanical switch, thermostat and temperature controller and electrical motor.

In the present invention, instead of the small gear type water pump and its non-return valve, the main water pump 16 is driven for a short time, after the engine stops running, at a low speed of rotation to cause the desired rate of flow (such as 10 gpm) to perform the cooling function in an efficient and effective manner. Electrical motor 21 connected in the engine's electrical system drives the main water pump 16 through the mechanism of two over-running clutches 17 and 18 of a type available on the open market. Clutch 17 is mounted on the engine's accessory shaft 19 and clutch 18 is mounted on the electrical motor shaft 20. The motor 21 responds to an over-temperature signal from a thermostat 22 that is plugged in the coolant section of the engine block 23. The control circuit is designed so that when the coolant temperature is above a predetermined value, preferably 177° F, the thermostat 22 and the relay in the controller box 37, as shown in FIG. 6, close the circuit to cause the electrical motor to run thereby driving the main water pump through the clutches 17 and 18 at a rate of speed sufficient to force the desired amount of coolant, preferably 10 gpm, to flow through the system.

Figure 2:
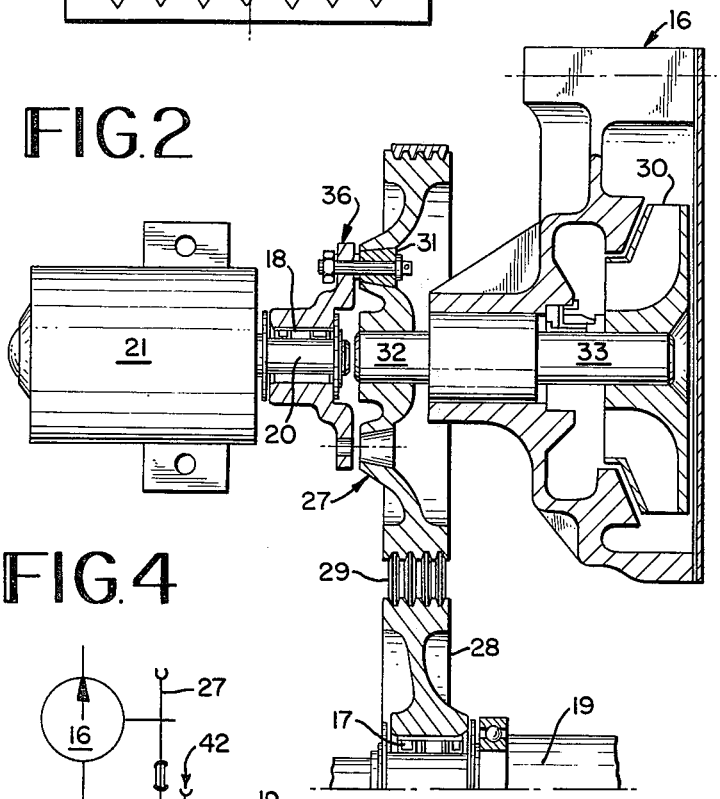
FIG. 2 is an enlarged layout cross section of structure within the area of the circle A in FIG. 1 to show the electrical motor main water pump assembly, over-running clutches and a partial section of the accessory shaft.

The housing 36 assembled on the over-running clutch 18 is bolted into the pulley 27 of the water pump 16 as seen best in FIG. 2. The pulley 27 is connected to the accessory shaft pulley 28 by means of a belt 29, the pulley 28 being assembled on the over-running clutch 17 which in turn is assembled to the accessory drive shaft 19 as illustrated in FIG. 2.

Rotation of the motor's shaft 20 causes the rollers of over-running clutch 18, positioned by the retainer spring, to advance into locked positions on ramps so that the entire unit rotates with the shaft 20 causing the pulley 27 to rotate and thereby acting through shaft sections 32 and 33 to rotate the impeller 30 of the pump. At the same time, rotation of the belt pulley 29 and 28 on the accessory shaft 19 causes instant disengagement of the rollers from the ramp of the over-running clutch 17 and permits low friction over-running. When the engine is running the rollers of the over-running clutch 17 on the accessory shaft advance into locked position on ramps and rotate the water pump impeller 30, the housing 36 of the over-running clutch 18 of the electrical motor 21 and over-run the electrical motor shaft 20.

In FIG. 2 the over-running clutch 18 is assembled on the electrical motor shaft 20 which is on the same center line as the main water pump 16 which is fixed on the engine's block. The housing 36 of the over-running clutch 18 is bolted to the pump pulley 27 by means of flexible joints 31. The pump pulley 27 is driven by a belt 29 from pulley 28 and over-running clutch 17 which is assembled on the engine's accessory shaft 19.

Figure 4:
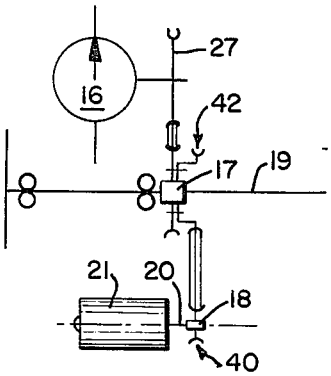
FIG. 4 is a schematic arrangement of another version of the invention.
Figure 3:
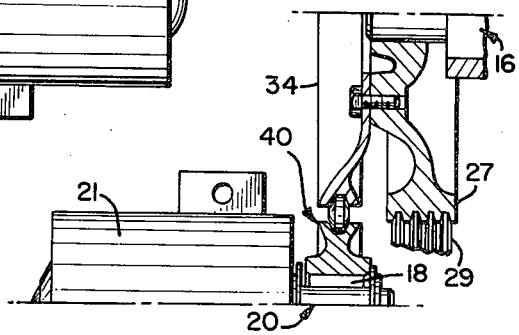
FIG. 3 is a partial section similar to FIG. 2 showing a modified form of the invention and illustrating a different drive ratio than the structure of FIG. 2.
Figure 5:
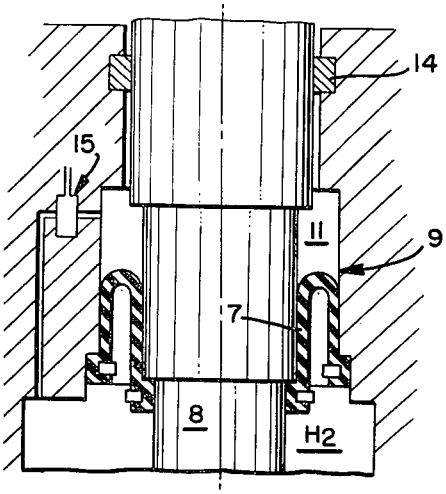
FIG. 5 is an enlarged vertical cross section and schematic view showing a roll sock seal fitted around a piston rod and high pressure part of the crankcase.

If desired, the electrical motor 21 could be assembled in parallel with the water pump 16 for different drive ratios and higher rpm of the electrical motor. As shown in FIG. 3, the over-running clutch 18 is mounted on the output shaft 20 of the electrical motor 21, a small pulley 40 is mounted on the clutch 18 and drives the pump 16 over a pulley belt assembly 34 that is bolted to pulley 27. The pump's fixed pulley 27 is driven by a belt 29 from a pulley 28 and over-running clutch 17 which is mounted on the engine's accessory drive shaft 19. In FIG. 4, the over-running clutch 18 and pulley 40 are assembled on the motor's output shaft 20 to drive the over-running clutch 17 and pulley 42 assembly on the accessory shaft 19 and the drive is transmitted to the pulley 27 of the pump 16. The over-running clutches 17 and 18 are mounted on the accessory drive shaft 19 and electrical motor shaft 20.

When the shaft 19 drives the housing 36, FIG. 2, or pulley 40, FIGS. 3 and 4, at faster rpm than the rpm of the shaft 20, the rollers of the over-running clutch 18 instantly disengage from the ramp permitting the housing 36 or the pulley 40 to low friction over-run the shaft 20 and permitting the accessory drive shaft to drive the pump's impeller 30; or, when the shaft 20 drives the pulley 28 at faster rpm than the rpm of the shaft 19, the rollers of the over-running clutch 17 instantly disengage from the ramp permitting the pulley 28 to low friction over-run the shaft 19 and permitting the motor's shaft 20 to drive the pump.

In regard to this application as illustrated in FIG. 2 the electrical motor is designed to drive the pump at a speed of 340 rpm, which is less than the idle speed of the engine of 600 rpm and idle pump of 750 rpm, so at engine idle speed, the housing 36 speed is 750 rpm against zero rpm for the electrical motor shaft 20 when it is not running, and 340 rpm for the shaft 20 when the electrical motor is running and in both cases the housing 36 will over-run the shaft 20; or, as illustrated in FIGS. 3 and 4, the pulley 40 speed at engine idle is 1500 rpm against 680 rpm for the electrical motor shaft 20 for drive ratio 2/1; and the motor is running or stopping and that is illustrated in FIGS. 3 and 4. So, at all times when the engine is running the pump will be driven by the engine and its accessory shaft 19.

The electrical motor specifications are 12 Volts, 17 watts, and 1.35 amperes and is designed and connected in a circuit to drive the pump at 340 rpm, and as shown in FIGS. 6 and 1; the circuit consists of a 12V battery connected in series to a mechanical switch 38, temperature controller box 37 which is connected to a thermostat 22, the thermostat is plugged in the engine cooling system cooler section 23 to detect the temperature rise and to send a signal to the relay in the controller box 37; the circuit is connected to the electrical motor which takes from the battery 1.35 amperes, 12 V; to run the pump (direct or over drive ratios) at 340 rpm; 0.02 B.P.H. and 10 gpm coolant flow.

The mechanical switch 38 could be located in a suitable place such as in the inside of the car to turn off the circuit operating the electrical motor when desired to prevent automatic operation.

The thermostat 22 plugged in the engine cooler section provides low potential difference and an electric current to a relay mounted on the on/off switch in a controller box 37 the relay energizes according to a setpoint temperature. The switching action is "on" and the electrical motor 21 will run when the indicator in the controller box indicates that the temperature of the coolant is above the setpoint temperature of 177° F, and "off" when the temperature is below 177° F. The setpoint accuracy of this controller is ± 1%.

Another type of temperature controller that could be used, the controller box consists of a snap switch actuated through a mechanism by a remote bulb, liquid filled thermal system, plugged in the engine cooling system, the same thermal system is used to operate a sector and pinion in the box to magnify the motion of the thermal system for temperature indication. The switching action is "on" and the electrical motor 21 runs when the indicator in the controller box indicates that the temperature of the coolant is above the setpoint temperature of 177° F, and off when the temperature is below 177° F; the accuracy of this controller is ± 1.5 to 2%.

Figure 7:
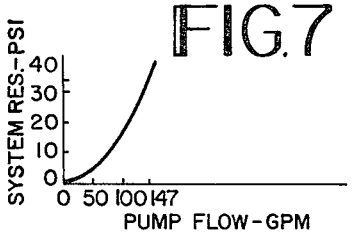
FIGS. 7, 8, 9, 10, 11, 12, and 13 are curves showing performance characteristics of the main water pump when it is working at a full capacity to cool the engine and when it is working at partial capacity to cool the roll sock seal in accordance with this invention.
Figure 8:
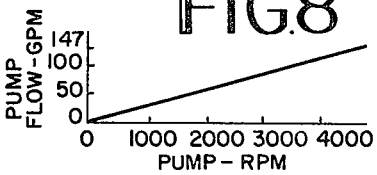
Figure 9:
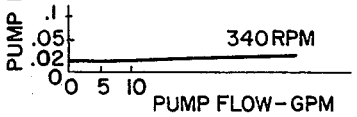
Figure 10:
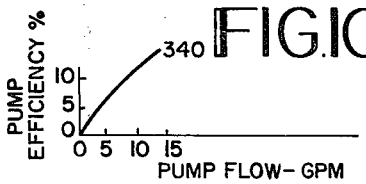
Figure 11:
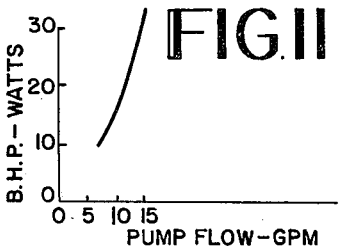
Figure 12:
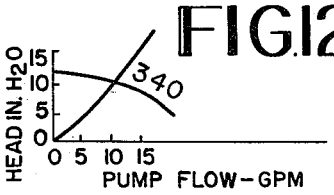
Figure 13:
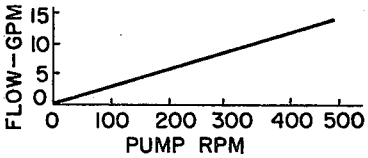

As those working with engines will recognize, FIGS. 9–13 show various performance characteristics. They are based on a main water pump operation of 340 rpm, 10 gpm flow, 10.88 in. water head, pump shaft B.H.P. 0.02, and pump power of 14.9 watts. Various drive ratios such as 1/1, 2/1 (i.e., motor at 680 rpm and pump at 340 rpm) and 3/1 can be used. In these three cases the pump rpm is 340 and the gpm is 10, the motor power watts remains at 16.18, and the motor amperage at 1.35. At 340 rpm the motor torque in foot pounds is 0.334, at 680 rpm it is 0.167, and at 1020 motor rpm it is 0.11, in all cases the motor B.H.P. being 0.0216. FIG. 13 shows flow vs. rpm, FIG. 12 shows head vs. flow; FIGS. 9 and 11 are B.H.P. vs. flow; FIG. 10 shows the total efficiency vs. flow. These are the performance characteristics of the main water pump working as a mini-pump. FIG. 7 shows the system resistance vs. flow and FIG. 8 shows the pump flow vs. rpm and are the performance characteristics of the main water pump when cooling the engine and working at its full capacity.

The invention, therefore, provides a means to guard the roll sock seal against damage from over heating when the engine is not running and is still hot. It does this by driving the main water pump at, for example, 340 rpm to cause 10 gpm of coolant to flow through the system. The main water pump is driven by a direct current from the motor operated by the engine battery which will, for example, need 1.35 amperes and 16 to 17 watts. The drive connection between the electrical motor and the pump is by means of two over-running clutches, one of which is on the motor shaft and the other on the engine accessory shaft.

As compared with the use of a separate gear type mini-pump as heretofore proposed, the invention greatly reduces the weight, cost, and space of components involved in the cooling process and improves the cooling efficiency of the main water pump by eliminating the mini-gear pump, the non-return valve and its pressure drop from the cooling system. It also eliminates the resistance of the main water pump as an additional pressure drop acting against the working head of the mini-pump.

The component parts are of ordinary design, can be readily made or purchased and readily assembled. The electrical and mechanical connections and installations are easy to make and contrive utilizing the basic concept of the invention of using the main water pump.

Figure 14:
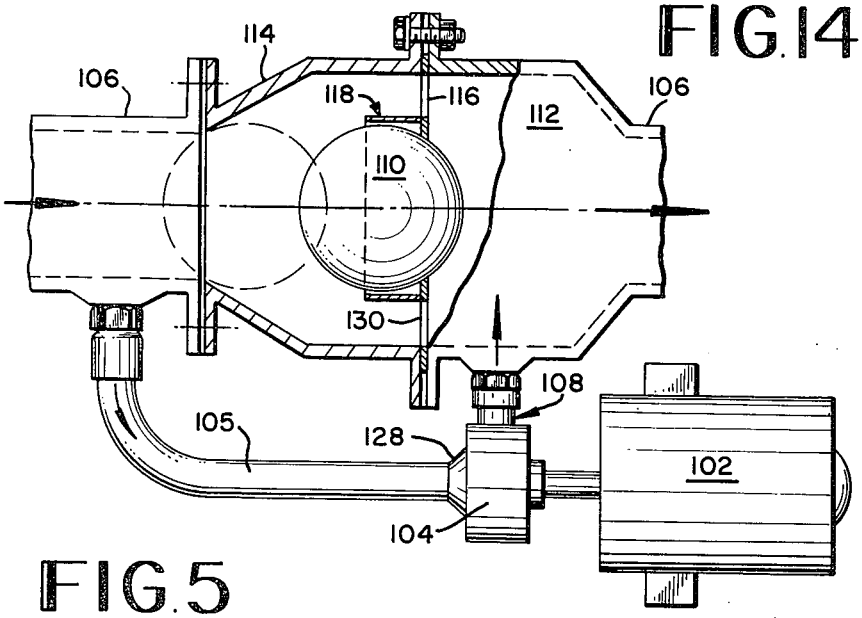
FIGS. 14–16 show a valve for use with a mini-pump in a Stirling engine roll sock system.
Figure 15:
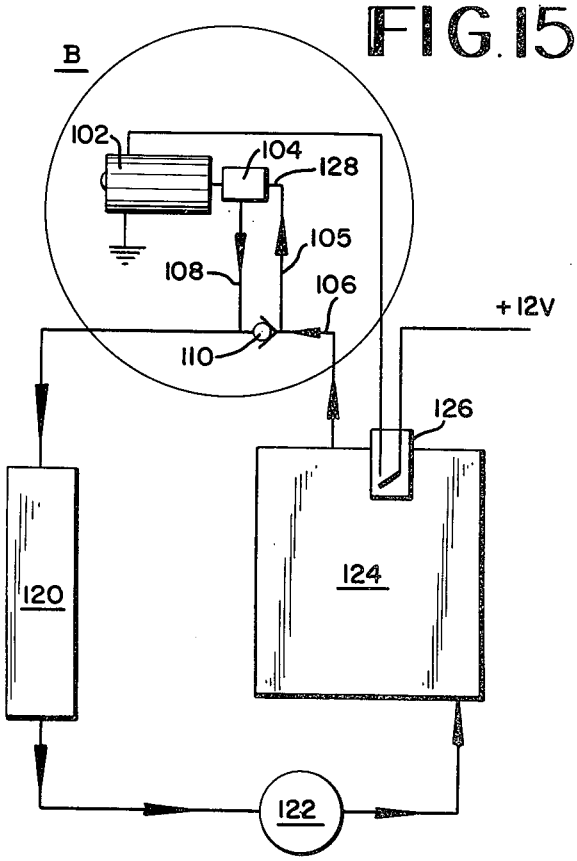
Figure 16:
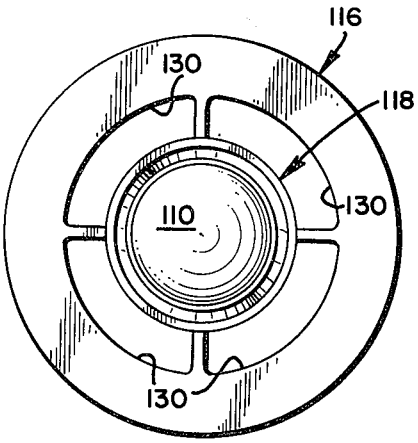

FIGS. 14 to 16 show another arrangement to solve the over heating problem of the roll sock seals. It uses a mini-pump as proposed by others but with a float ball valve which has lower pressure drop than the prior non-return valve and which closes the passage fast and accurately and is simpler in design. A small electrical motor 102 drives the mini-gear pump 104 which has an inlet connected by duct 105 to the main duct 106 and an outlet connected by duct 108 to main duct 106; a float ball valve 110 is designed into an enlarged portion 112 and 114 of the main duct 106; the float ball 110 cooperates with a valve seat 116 having an annular guide flange 118. The seat is formed in flange of the enlarged portions 112 and 114 as seen in FIG. 14.

When the mini-pump 104 begins to pump the coolant the float ball valve 110 begins to flow with the flowing coolant toward the passage. Another factor helps the floating valve to close the passage is the tapered diffuser 114 and its pressure difference. The mini-gear pump 104 is driven by the electrical motor 102 and runs when the circuit is closed. The circuit will close only when the temperature of the engine 124 reaches above specified value; at which point a signal from thermostat 126 will close the circuit causing the electrical motor 102 and the pump 104 to run forcing the 10 gpm of the coolant through the system including radiator 120, main water pump 122, cooling the engine and going back to the inlet 128 of the mini-gear pump 104; when the engine temperature returns to its specified value the thermostat 126 will cut off the circuit and the motor 102 and pump 104 will cease to operate.

When the engine is running coolant flow seats the ball 110 and flows through the four openings 130 in plate 116 which have the total area about equal to the cross sectional area of duct 106. When the engine is not running, the coolant from mini-pump 104 forces the ball 110 to the left to the dotted line position to close off the inlet to the unit 114.

I claim:

1. The method of cooling the roll sock seals of a Stirling type external combustion engine having a main coolant system with a main water pump which comprises running the main water pump of the engine at a reduced rate of speed after the engine has stopped to force coolant in said main system to circulate in heat transfer relationship with said roll sock seals until the temperature of the coolant in said main system drops to a preselected level.

2. A Stirling engine having an electrical system, a cooling system with a main water pump having a normal rate of speed, and roll sock seals in heat transfer relationship with the cooling system, an electrical motor receiving electrical power from the electrical system and capable of rotating the main water pump at a rate of speed substantially less than said normal rate to force coolant through the cooling system at a reduced rate of flow, means providing that said electrical motor receives electrical power even after the engine has stopped running, torque transfer and control means operatively connecting the motor to the pump to drive the pump, and thermostat-relay controller means connected to and responsive to the temperature of the coolant for disconnecting the motor when the temperature of the coolant falls below a predetermined level.

3. A device as set forth in claim 2 wherein said means comprises over-running clutch means.

4. A device as set forth in claim 3 wherein said means comprises an over-running clutch between the motor and the water pump and an over-running clutch between the water pump and the engine accessory drive shaft that furnishes power to the pump.

5. A Stirling engine having an electrical system, a cooling system with a main water pump, and roll sock seals in heat transfer relationship with the system, a small pump in said cooling system and operated by said electrical system when the engine is off and the temperature of the coolant exceeds a predetermined level and capable of moving coolant through the system at a reduced rate of flow as compared with normal engine operation, and a floating ball type non-return valve in the cooling system and operatively arranged with respect to the small pump and main pump.

6. A device as set forth in claim 5 including a housing for the ball valve, a plate extending transversely across the housing and having a valve seat formed therein cooperating with the ball, the inlet side of said housing being tapered.

* * * * *